United States Patent [19]

Reber

[11] Patent Number: 4,839,971

[45] Date of Patent: Jun. 20, 1989

[54] FRONT PIECE FOR SHOES

[76] Inventor: Werner Reber, Hauensteiner Strasse 22, D-6783, Dahn, Fed. Rep. of Germany

[21] Appl. No.: 156,804

[22] Filed: Feb. 17, 1988

[30] Foreign Application Priority Data

Mar. 6, 1987 [DE] Fed. Rep. of Germany ... 8703425[U]

[51] Int. Cl.[4] ..... A43C 13/14

[52] U.S. Cl. ..... 36/77 R; 36/72 R

[58] Field of Search ..... 36/77 R, 77 M, 72 R

[56] References Cited

U.S. PATENT DOCUMENTS 2,795,868 6/1957 Shultz ..... 36/77 R

FOREIGN PATENT DOCUMENTS 282012 2/1966 Australia ..... 36/77 R
839484 4/1970 Canada ..... 36/77 R
601696 9/1934 Fed. Rep. of Germany ..... 36/77 R
2935959 4/1981 Fed. Rep. of Germany ..... 36/77 R
1284736 8/1972 United Kingdom ..... 36/77 M
2050144 1/1981 United Kingdom ..... 36/77 R
2071989 9/1981 United Kingdom ..... 36/77 R

*Primary Examiner*—James Kee Chi

*Attorney, Agent, or Firm*—Foley & Lardner, Schwartz, Jeffery, Schwaab, Mack, Blumenthal & Evans

[57] ABSTRACT

The present invention relates to a front piece for shoes which is matched to the shape of the tip of the foot and is composed of a top part covering the tip of the foot and of a flank surrounding the tip and sides. The front piece is composed of a hard or elastic material which is produced in one piece and has, on its top part, a recess for fastening the upper and, around its flank, a further recess for receiving a surrounding or fastening strip. The top part of the front piece tapers towards the shoe into a soft thin lip. A shoe having a front piece is also disclosed.

9 Claims, 1 Drawing Sheet

FIG. 1
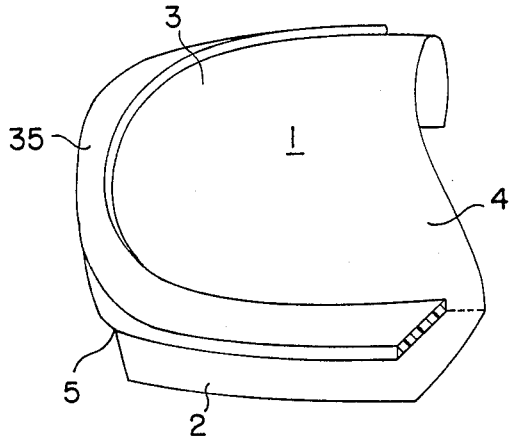
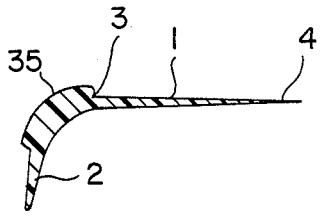
FIG. 2(a)
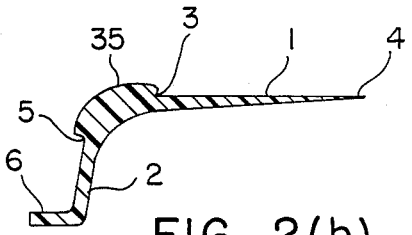
FIG. 2(b)
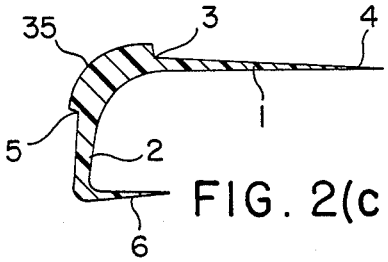
FIG. 2(c)
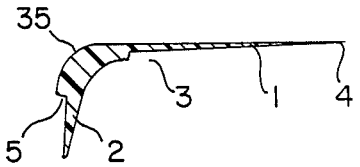
FIG. 2(d)
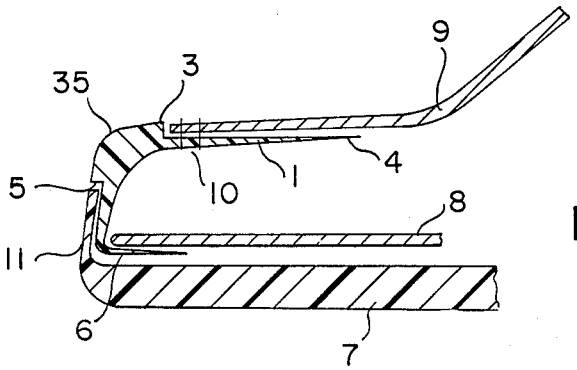
FIG. 3

FRONT PIECE FOR SHOES

BACKGROUND OF THE INVENTION

The present invention relates to a preformed front piece for making shoes and to shoes made by using front pieces of this type.

Shoes having toe caps have been used for a long time, especially with protective boots. Such shoes protect against foot injury because of the presence of a steel front cap introduced between the upper and the lining or an additional cap made of tough cowhide attached onto the upper. Although these caps surrounding the foot or shoe from above are suitable for protecting the foot against pressure from above, they nevertheless have the disadvantage that the cap itself is inflexible, so that the shoe can only bend at the cap's end, and consequently the upper exerts increased pressure on the foot at this point. Furthermore, this cap must also be added onto the shoe with the upper having to be matched exactly to the shape of the cap, and particularly where the fashioning of the tip is concerned, this requires an additional work step involving the expensive use of additional machines and material.

SUMMARY OF THE INVENTION

It is an object of this invention to provide an assembly for a shoe for protecting toes while offering increased flexibility as opposed to conventional protective devices.

It is another object of this invention to provide a protective assembly for a shoe which reduces the need for shoe material as well as minimizes unwanted friction between the protective assembly and the connected shoe materials.

It is yet another object of this invention to provide a protective assembly for a front part of a shoe which is easily assembled with the shoe upper and the shoe sole or insole.

It is yet another object of this invention to provide a protective assembly for a shoe having a structure which readily receives the shoe upper and the shoe sole or insole.

It is yet an additional object of this invention to provide a protective assembly which permits simple and economical fastening of the shoe upper and the shoe sole or insole to the protective assembly.

In accomplishing the foregoing objects, there has been provided according to the present invention a front piece for making a shoe formed of a resilient material, generally having the shape of a shoe tip, having a top portion and a flank portion surrounding the front and sides, and a reinforced portion formed between the top portion and the flank portion; the top portion and the reinforced portion forming a first recess on one surface of the top portion for receiving a shoe upper and the top portion tapering in strength from front to back; and the flank portion and the reinforced portion forming a second generally vertically oriented recess on the outer surface of the flank portion for receiving a surrounding piece.

In a preferred embodiment, the invention further comprises a shoe assembly, comprising a front piece as described above, a shoe upper attached to the front piece in the first recess; and a shoe sole attached to the flank portion.

It is yet another object of this invention to provide a shoe having a front piece formed of resilient material.

Further objects, features and advantages of the present invention will become apparent from the detailed description of preferred embodiments which follows, when considered together with the attached figures of the drawings.

BRIEF DESCRIPTION OF THE DRAWINGS

In the drawings:

FIG. 1 shows a plan view of a front piece according to the invention;

FIGS. 2A–2D show four longitudinal sections through the front piece; and

FIG. 3 shows a shoe made by using a front piece according to the present invention.

DETAILED DESCRIPTION OF THE PREFERRED EMBODIMENTS

The present invention makes it possible, therefore, to both simplify shoe-making, especially the making of shoes with a reinforced front cap, and to make shoes which guarantee increased protection of the toe region and are more comfortable to wear.

According to the invention, a prefabricated front piece which performs the function of a cap incorporated in the shoe has the following features:

(a) it is matched to the shape of the tip of the foot and is composed of a top part covering the top of the foot and of a flank surrounding the tip and the sides;

(b) it is composed of an elastic material;

(c) the top part has, on its top side or underside, a recess for fastening the shoe upper;

(d) the top part is made thicker and/or firmer in its front portion and tapers rearwardly into a soft thin lip; and (e) an essentially vertical recess for receiving a surrounding piece, cover strip or a sole is provided around the flank.

In a particularly advantageous embodiment, this front piece also has a tongue which is formed on the bottom edge of the flank so as to project approximately perpendicularly outwardly or inwardly.

This front piece is produced from a strong but elastic material, for example, a plastic, especially soft polyvinyl chloride, thermoplastic rubber, polyurethane, polystyrene or ethylenevinyl acetate. The material must be so strong and dimensionally stable that it preserves the shape of the shoe and, if appropriate, is also capable of protecting the foot against mechanical effects, and on the other hand, it must be so flexible that it can yield to the movement of the foot and to the deformation of the shoe resulting from such movement. These objects are achieved by an appropriate coordination of the wall thicknesses and by the choice of material.

The correct shape of the front piece can be formed by pressing or injection molding using suitable molds.

Of course, to the extent the material properties, the production method and the decorative qualities allow, the front piece which is conventionally produced in one piece can also be made in separate individual parts, such as, for example, the top side, the annular bulge and the flank. These parts can then be glued together, welded or stitched only when ready to be incorporated in the shoe. Since this requires additional working steps, this production method is less advantageous than a production method in which the front piece is conventionally produced in one piece.

In a shoe made in accordance with the invention, the front piece is joined to the leg or upper in such a way that the upper is positioned in the recess on the top part. This recess is on the top side or underside, depending on the visual effect desired. The upper can be either glued firmly or stitched on by means of one or more seams. By means of the vertical recess in the flank of the top part, the upper is either fitted into a corresponding continuous surrounding piece of the shoe or a cover strip is fastened in this vertical recess. A tongue formed on the surrounding piece or the cap itself and pointing outwardly or inwardly serves to fasten the sole and/or insole, and these are glued or stitched on in a known way. To the extent this tongue exceeds a certain thickness, a cavity formed between the insole and this cavity must be filled with an insert sole or a suitable filling material.

In a shoe made according to the invention, there remains between the shoe upper fixed in the top recess, and the surrounding piece or cover strip fixed in the vertical recess, a reinforced edge which is not covered by the upper and which not only offers increased protection, but also, through appropriate coloring or trimming, can be adapted to suit a range of fashion choices.

Because the front piece is made of plastic, it is directly possible to produce the appropriate regions in different thicknesses and shapes and, in particular, to form rounded portions which are difficult to form in leather. The parts of the front piece to which the upper or the surrounding piece is fastened are planar, or curved in only one direction, so that they can be joined to the smooth leather without difficulty. The "toe-pinching" which is a particular problem in conventional shoes, or the exact stitching of the various parts of the upper required in the making of "California" shoes, are therefore replaced by straight seams or bonding surfaces. Consequently, corresponding shoes can be made substantially more economically and simply.

FIG. 1 shows a front piece comprising a top part 1 and a surrounding flank 2 extending approximaty vertically. A recess 3, in which an upper 9 is fastened, is formed in the top part 1. To avoid projecting edges, the depth of the recess 3 corresponds to the thickness of the upper 9 which is fastened in it. The top part 1 tapers towards the shoe into a thin flexible lip 4 which forms a uniform transition between the firm front piece and the flexible upper 9. A further recess 5 extends around the flank 2 and is adapted to receive a surrounding piece or cover strip 11. Between these two recesses remains a thicker bulge 35 which provides the mechanical strength of the front piece and which terminates at a first step in the direction toward the shoe, so that the upper 9 butts therewith and which curves downwardly and extends toward the sole 7, terminating at a second step so that the surrounding piece 11 butts therewith.

FIGS. 2A–2D show longitudinal sections through four embodiments of the front piece according to the invention. FIG. 2A shows the front piece designed so that the flank 2 butts vertically against the edge of the sole 7, so that an appropriate surrounding piece 11 is required for fastening.

FIG. 2B shows an embodiment having an additional tongue 6 which is formed on the flank pointing horizontally outwardly away from the shoe, and which is fastened to the sole 7 by means of a seam running around on the outside, in the manner of many sports shoes.

FIG. 2C shows a similar tongue 6 which extends horizontally inwardly toward the shoe, and which results in a blind seam or bonding point. This is especially desirable in more elegant shoes. At the same time, the tongue 6 itself tapers to an edge at an acute angle, so that there is no need for an insert sole for subsequent assembly.

FIG. 2D shows a front piece in which the recess 3 is located on the underside of the top part 1, with the result that the part of the front piece which is visible is especially large. The remaining parts correspond to those of FIGS. 2A.

FIG. 3 shows the incorporation of a front piece according to FIG. 2C into a finished shoe front piece, the upper 9 resting on the top part 1 of the front piece and normally being glued thereto. The drawing indicates an additional seam 10 primarily for decorative purposes but which also serves to reinforce the connection. The inwardly-pointing tongue 6, which is tapered at an acute angle as in FIG. 2C, is glued on its top surface to the insole 8 and on its bottom surface to the actual outsole 7. The gap appearing between the two soles by reason of the drawing is, of course, not present in the normal production method, and the two soles are bonded directly to one another or filled with filler or an air cushion. In the figure shown, the sole 7 tapers into lip 11 which acts as a cover strip and which is glued into the recess 5 around the flank 2, thereby giving the visual impression of an especially thick sole. Of course, a similar impression can also be obtained by means of a separate surrounding fastening strip 11.

Additional embodiments not described herein which would be obvious to a person of ordinary skill in the art are considered to be within the scope of the invention.

What is claimed is:

1. A reinforced toe-piece for a shoe comprising:

a front piece comprised of a resilient synthetic material generally having the shape of a shoe tip, including a top portion , a flank portion and a reinforced intermediate portion formed to interconnect said top portion and said flank portion, said reinforced portion having an increased thickness relative to the top and flank portions;

said top portion and said reinforced portion having a first step forming a first recess on a surface of said top portion for receiving a shoe upper and said top portion tapering in thickness from front to back; and said flank portion and said reinforced portion having a second step forming a second recess on a surface of said flank portion for receiving a surrounding piece.

2. A reinforced toe piece as claimed in claim 1, wherein said flank portion further comprises a tongue projecting from said flank portion at substantially a right angle for fastening to a sole or an insole of a shoe.

3. A reinforced toe piece as claimed in claim 1, wherein said piece is composed of an elastic material.

4. A reinforced toe piece as claimed in claim 1, wherein said piece comprises a single integral piece.

5. A reinforced toe piece as claimed in claim 1, wherein said top portion tapers in thickness from front to back, to form a thin flexible lip at the back.

6. A reinforced toe piece as claimed in claim 1, wherein said first recess is on the a surface of said top portion.

7. A reinforced toe-piece as claimed in claim 1. wherein said first recess is on a bottom surface of r top portion.

8. A shoe assembly comprising:

a reinforced toe- piece comprised of a resilient synthetic material generally having the shape of a shoe tip, including a top portion , a flank portion and a reinforced intermediate portion formed to interconnect said top portion and said flank portion, said reinforced portion having an increased thickness relative to the top and flank portions;

said top portion and said reinforced portion having a first step forming a first recess on a surface of said top portion for receiving a shoe upper and said top portion tapering in thickness from front to back;

said flank portion and said reinforced portion having a second step forming a second recess on a surface of said flank portion for receiving a surrounding piece;

the shoe upper abutting said first step and attached to said piece in said first recess; the surrounding piece abutting said second step and attached to said piece in said second recess; and a shoe sole attached to said flank portion.

9. A shoe assembly as claimed in claim 8, wherein said sole is fastened to said flank portion by a seam.

* * * * *